US007568556B2

(12) United States Patent
Hikita

(10) Patent No.: US 7,568,556 B2
(45) Date of Patent: Aug. 4, 2009

(54) ELEVATOR GROUP MANAGEMENT CONTROL DEVICE

(75) Inventor: Shiro Hikita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 352 days.

(21) Appl. No.: 11/574,017

(22) PCT Filed: Oct. 26, 2005

(86) PCT No.: PCT/JP2005/019675

§ 371 (c)(1),
(2), (4) Date: Feb. 21, 2007

(87) PCT Pub. No.: WO2007/049342

PCT Pub. Date: May 3, 2007

(65) Prior Publication Data

US 2009/0032339 A1 Feb. 5, 2009

(51) Int. Cl.
*B66B 1/18* (2006.01)

(52) U.S. Cl. ..... 187/382; 187/247

(58) Field of Classification Search ..... 187/247, 187/248, 380–388, 391–393; 706/903, 910
See application file for complete search history.

(56) References Cited

U.S. PATENT DOCUMENTS 4,337,847 A * 7/1982 Schroder et al. ..... 187/247
5,022,497 A * 6/1991 Thanagavelu ..... 187/382
5,892,190 A * 4/1999 Morita et al. ..... 187/382
6,655,501 B2 * 12/2003 Kostka ..... 187/382
7,275,623 B2 * 10/2007 Tyni et al. ..... 187/382
2008/0105499 A1 * 5/2008 Tyni et al. ..... 187/382

FOREIGN PATENT DOCUMENTS

| | | |
|---|---|---|
| JP | 51-21638 | 2/1976 |
| JP | 54-159955 | 12/1979 |
| JP | 58-69675 | 4/1983 |
| JP | 60-106774 | 6/1985 |
| JP | 62-70 | 1/1987 |
| JP | 01-054273 | 11/1989 |
| JP | 10-036019 | 2/1998 |
| JP | 2002-167129 | 6/2002 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

An elevator group management controller, that: predicts an arrival time each elevator car can arrive from a present position to a floor where a hall call is generated; estimates a travel distance for each car from its present position to stop in response to every car call to be handled by the car; calculates a waiting time with respect to the hall call based upon the predicted arrival time, for evaluating a waiting time by employing a first evaluation function while the waiting time is employed as an evaluation index, and for evaluating a travel distance by employing a second evaluation function employing the estimated travel distance as an evaluation index; and calculates an integral evaluation function containing at least the waiting time evaluation and travel distance evaluation for each car, and assigns a car whose integral evaluation function value is minimum with respect to the hall call.

20 Claims, 5 Drawing Sheets

ELEVATOR GROUP MANAGEMENT CONTROL DEVICE

TECHNICAL FIELD

The present invention relates to an elevator group management control device for efficiently operating a plurality of elevators.

BACKGROUND ART

In the case where a plurality of elevators are operated within a building, group management control operation is normally carried out. A group management control device operates an elevator group which is under control of the group management control device in an organic manner so as to reduce waiting time. One of the purposes of employing his group management control device is to save energy.

In a conventional elevator group management control device, the number of calls acceptable is previously set for each floor, and when the number of hall calls registered at a certain floor is equal to or larger than the number of calls acceptable, assignment of an elevator to the floor is restricted (refer to, or example, Patent Document 1). As a consequence, use of the elevators is restricted so as to reduce energy consumption.

There is also another conventional elevator group management control device, in which: in a waiting control operation during off-peak operation, hail call occurrence probability of respective floors is estimated; when plural floors have the hall call occurrence probability limited within a predetermined range, a floor located near an available elevator among the plural floors is defined as a waiting floor assuming priority (refer to, for example, Patent Document 2). As a result, travel distances of the elevators to reach the waiting floor are reduced, as compared with that of the waiting floor fixed system, to thereby improve energy saving effects.

There is further another conventional elevator group management control device, in which an estimated value of energy required by each of the cars for reaching a target floor is calculated, an evaluation value calculated from this estimated value of energy is added to an evaluation value for determining a car to assigned with respect to a new hall call, to thereby achieve energy saving effects (refer to, for example, Patent Document 3).

Patent Document 1: JP 2002-167129 A

Patent Document 2: JP 10-36019 A

Patent Document 3: WO05/009880

DISCLOSURE OF THE INVENTION

Problem to be Solved by the Invention

However, in the above-explained conventional elevator group management control device, in such a case that the number of hall calls generated exceeds the preset number of car calls acceptable, passengers cannot get in an elevator at the floor. Therefore, there is a problem in that these passengers may feel very inconvenient. Also, when the number of hall calls generated is smaller than the preset number of car calls acceptable, the completely same effect as that of the normal elevator control operation is obtained. As a result, there is such a problem that the energy saving effect can be hardly expected.

Also, in the above-explained conventional elevator group management control device, although the effect of reducing the travel distances is achieved, the waiting control operation is rarely carried out, and further, the travel distances to the waiting floor are not so long. As a result, there is another problem in that the energy saving effect that can be achieved as a whole is very little.

Moreover, in the above-explained conventional elevator group management control device, the energy saving effect can be achieved while the call assigning operation is performed. However, if the evaluation with respect to this energy saving effect is increased, there is such a risk that the transportation efficiency is deteriorated, namely, the waiting time is increased, resulting in another problem.

The present invention has been made to solve the above explained problems, and therefore, it is an object of the invention to provide an elevator group management control device capable of operating a plurality of elevators in an organic manner, and thus, capable of achieving an energy saving effect without increasing waiting times.

Means for Solving the Problems

The present invention provides an elevator group management control device for efficiently operating a plurality of elevators, including estimation calculating means for predicting an arrival time by which each car of the elevators can arrive from a present position to a floor where a hall call is generated; travel distance estimating means for estimating a travel distance for each car over which the car travels from the present positions respectively to stop in response to every car call that is to be handled by the car; evaluation calculating means for calculating a waiting time with respect to the hall call based upon the arrival time predicted by the estimation calculating means, for performing a waiting time evaluating calculation by employing a first evaluation function while the waiting time is employed as an evaluation index and also for performing a travel distance evaluating calculation by employing a second evaluation function while the travel distance estimated by the travel distance estimating means is employed as an evaluation index; and assigning means for performing a calculation of an integral evaluation function which contains at least the waiting time evaluation and the travel distance evaluation as to each of the cars, and for assigning a car whose integral evaluation function value is minimum with respect to the hall call.

Effect of the Invention

The elevator group management control device according to the present invention is provided with the means for determining a car to be assigned. That is, in such a case that a hall call is generated in a building where a plurality of elevators are operated, the above-explained means determines the car to be assigned by evaluating a total travel distance when at least the respective cars are assigned to this hall call. As a consequence, such an effect can be achieved that the travel distances of the respective elevators can be reduced, and the energy saving effect can be achieved without increasing the waiting time.

BEST MODE FOR CARRYING OUT THE INVENTION

Figure 1:
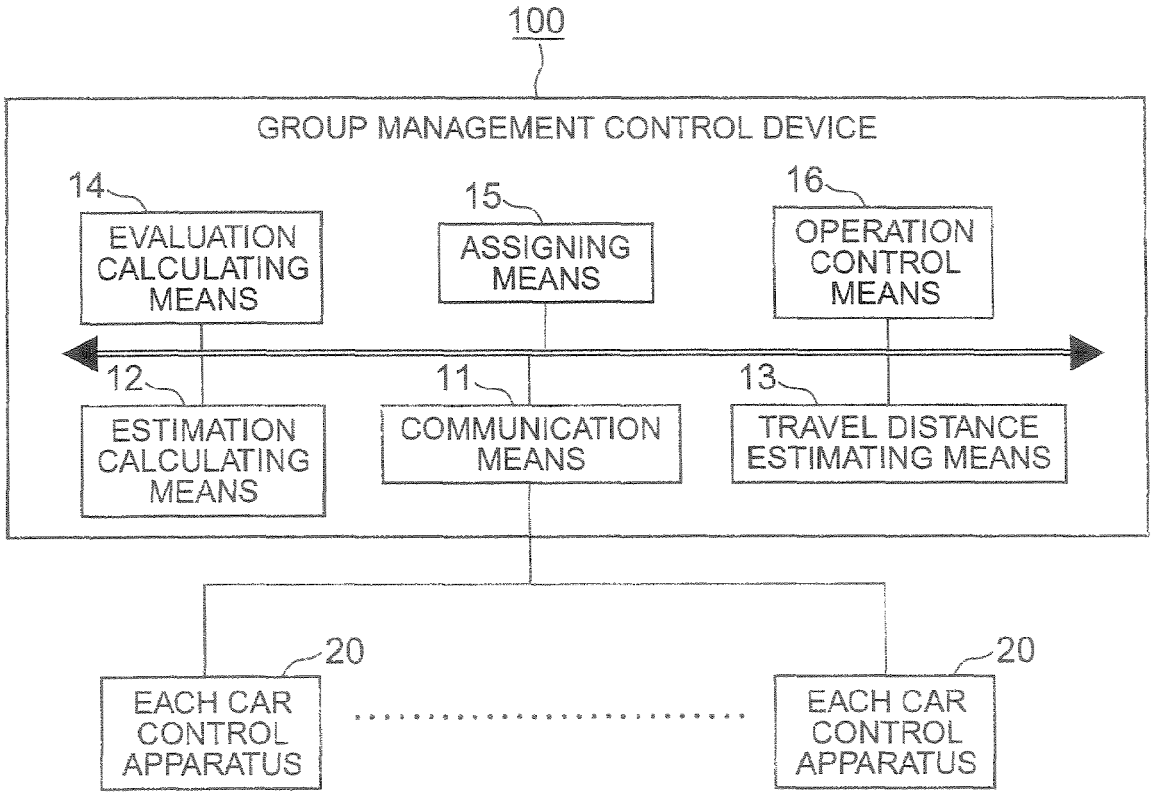
[FIG. 1] A block diagram for showing a functional arrangement of an elevator group management control device according to Embodiment 1 of the present invention.

Embodiment 1 and Embodiment 2 of the present invention will now be explained. It should be understood that the same reference numerals shown in the respective drawings are employed as those for denoting the same, or similar structural elements.

Embodiment 1

An elevator group management control device according to Embodiment 1 of the present invention will now be explained with reference to FIG. 1 to FIG. 3. FIG. 1 is a block diagram for showing a functional arrangement of the elevator group management control device according to Embodiment 1 of the present invention.

In FIG. 1, a group management control device 100 efficiently supervises (i.e., assigns)/controls a plurality of cars (not shown), and a plurality of each car control apparatuses 20 control each of the cars respectively. The plurality of each car control apparatuses 20 are connected to the group management control device 100.

Also, the group management control device 100 includes communication means 11, estimation calculating means 12, travel distance estimating means 13, evaluation calculating means 14, assigning means 15 and operation control means 16. The respective means 11 to 16 are constructed by software on a microcomputer.

The communication means 11 communicates information with respect to the each car control apparatuses 20, and the like. The estimation calculating means 12 performs a prediction calculation as to for example, how many seconds it takes for each of elevators to reach each of floors. The travel distance estimating means 13 estimates a travel distance until each of the elevators stops in response to all of elevator calls assigned thereto. The evaluation calculation means 14 calculates various sorts of evaluation items such as waiting time evaluation and travel distance evaluation based upon calculation results of the estimation calculating means 12 and the travel distance estimating means 13. The assigning means 15 performs integral evaluation based upon the evaluation calculation result of the evaluation calculating means 14 to assign a proper elevator (i.e., car) with respect to a new hall call. The operation control means 16 controls operation of each of the elevators according to an assigned result.

Next, operations of the elevator group management control device according to Embodiment 1 will now be described with reference to drawings. FIG. 2 is a flow chart for describing operations of the elevator group management control device according to Embodiment 1 of the present invention. FIG. 3 is a diagram for explaining an operation of the travel distance estimating means of the elevator group management control device according to Embodiment 1 of the present invention.

First, when a hall call is newly registered in a step S100, the estimation calculating means 12 performs a prediction calculation with respect to each of the cars in a step S101. This prediction calculation includes arrival time prediction predicting, for example, how many seconds it takes for each of the cars to arrive at each floor, passenger number prediction on each floor, and in-car passenger number prediction made in connection with the above-mentioned passenger number prediction, while the prediction calculation is realized by, for instance, the method described in JP-A 54-102745. Since the prediction calculation has been so far widely employed in elevator group management systems, detailed explanations thereof are omitted.

Next, in a step S102, the travel distance estimating means 13 performs a prediction calculation of a travel distance. The prediction calculation of the travel distance will now be explained with reference to FIG. 3. In FIG. 3(*a*), a car 30 is traveling from "10F (i.e., tenth floor: uppermost floor)" in "Down i.e., descent)" direction, and the car 30 owns a car call (denoted by symbol "○") at "1F (i.e., first floor: lowermost floor)" and Down hall call (denoted by symbol "∇"). In this case, if the elevator can 30 definitely travels from 10F through 6F to 1F and the car 30 is not assigned by another car call, the operation of the car 30 is terminated. As a consequence, a distance from the tenth floor to the first floor (i.e., 10F→1F) is estimated as the travel distance of the car 30.

In the opposite case with respect to the above-mentioned case in terms of travel direction of car etc., the travel distance estimation is made as described below. That is, in such a case that while the car travels from the lowermost floor (i.e., first floor) in an ascent direction, the car owns a car call at the uppermost floor (i.e., 10th floor) and an ascent hall call at an intermediate floor (i.e., 6th floor) between the lowermost floor and the uppermost floor, the travel distance estimating means 13 estimates a distance measured from the lowermost floor to the uppermost floor as the travel distance of the car.

Figure 3A:
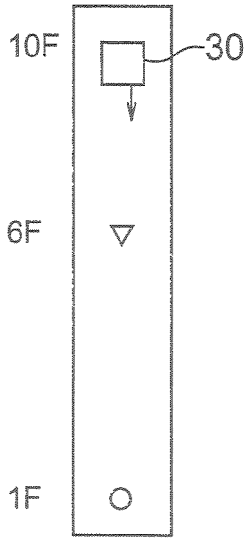
[FIG. 3] A diagram for explaining an operation of travel distance estimating means of the elevator group management control device according to Embodiment 1 of the present invention.
Figure 3B:
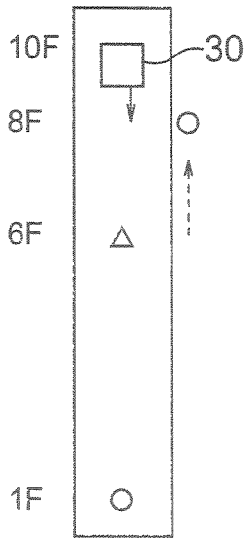

In FIG. 3(*b*), the car 30 is traveling from 10F in the Down direction, and owns car call (denoted by symbol "○") at 1F and an Up (i.e., ascent) hall call (denoted by symbol "Δ"). In this case, the car 30 travels from 10F to 1F, the travel direction thereof is reversed at 1F, and thereafter, the car 30 travels at least up to 6. After the car 30 responds to the Up hall call of 6F, it is unclear at this time which floor located between 7F (i.e., seventh floor) and 10F a passenger present at this floor (i.e., 6F) selects as a destination floor, so prediction is required. As a method for the prediction, there is such a prediction method. That is, get-off probability from for example, the uppermost floor to the get-in floor (6F in this case), namely a get-off passenger number is added from the uppermost floor, and then, such a floor that the added get-off probability becomes 50 percents (%) is predicted to be the destination floor. This get-off probability (get-off passenger number) may be calculated if a transportation amount per day is statistically processed and studied. While a sum of a get-off passenger number at each floor from the uppermost floor to the get-in floor (6F) at a certain time and get-off passenger numbers from the uppermost floor to the get-in floor is calculated, the get-off passenger numbers are sequentially added to each other from the uppermost floor in the descent direction. Then, such a floor that this added value becomes equal to 50 percent (%) with respect to the sum of the get-off passenger numbers is predicted to be the destination floor.

Also, as the simplest method, such a method for predicting a just center floor between the uppermost floor and the get-in floor to be a prediction floor may be conceived FIG. 3(*b*) illustrates an example in which 8F (i.e., eighth floor) corresponding to the just center floor is predicted as the destination floor (i.e., car call denoted by symbol "○"). If prediction of the destination floor is performed with respect to each of hail calls to which a car has not yet responded in the above-explained manner, a travel route of the car may be predicted and a travel distance may be estimated. In FIG. 3(*b*), as one example, a distance defined from 10F→1F→6F→8F is estimated as the travel distance.

In the opposite case with respect to the above case in terms of travel direction of car etc., travel distance estimation is made as described below. That is, in such a case that while the car 30 travels from the lowermost floor (i.e., first floor) in an ascent direction, the car 30 owns a car call at the uppermost floor (i.e., 10th floor) and a descent hall call is generated at an intermediate floor (i.e., 6th floor) between the lowermost floor and the uppermost floor, the travel distance estimating means 13 predicts the destination floor as to the descent hall call, and also estimates a distance measured from the lowermost floor via the uppermost floor to the destination floor as the travel distance of the car.

Furthermore, in the case where the travel distance predicting means 13 predicts the destination floor as to the descent hall call, the travel distance estimating means 13 adds get-off probability of each floor from the lowermost floor up to the intermediate floor to each other, and then predicts such a floor that the added get-off probability becomes 50% to be the destination floor. Otherwise, the travel distance estimating means 13 predicts an intermediate floor between the lowermost floor and the intermediate floor to be the destination floor.

The predict on calculation of the step S101 and the travel distance estimation of the step S102 are carried out in such a case that a new hall call is provisionally assigned for every car, and also, in the case where the new hall call is not provisionally assigned for every car, and in order to represent this process operation, a return line is drawn from an exit of the step S102 to an entrance of the step S101.

Also, in a step S103, the evaluation calculating means 14 performs evaluation calculations of various sorts of evaluation indexes such as a waiting time and a travel distance based upon results of the prediction calculation executed in the steps S101 and S102. For instance, in the example shown in FIG. 3(*a*), if an arrival prediction time of the car 30 from the present position of 10F to 6F corresponding to the hall call occurring floor is 10 seconds later and 15 seconds have already elapsed after the hall call of 6F had occurred until now, the waiting time with respect to the hall call is calculated in such a way that 10 seconds+15 seconds=25 seconds. Then, evaluation with respect to the above-explained waiting time of 25 seconds is performed in such a manner that V (value)=f (25 seconds) by employing a predetermined evaluation function "f". It should be understood that as an evaluation index used in a group management control, not only a waiting time, but also a large number of evaluation indexes, such as mis-forecast probability and full-car probability, are employed. Since these evaluation indexes have been conventionally and widely employed, detailed explanations thereof are omitted.

It should also be noted that the above-mentioned procedures from the steps S101 to S103 are carried out with respect to each of the cars. In other words, the procedures from the prediction calculation to the evaluation calculation are carried out for each of these cars. In order to represent the procedures, a return line is drawn from the exit of the step S303 to the entrance of the step S101. Furthermore, as previously explained, the procedures of the step S101 and the step S102 are executed in both cases that the new hall call is assigned to each of the cars, and is not assigned thereto.

When the calculations of the various sorts of evaluation values are accomplished in the above-mentioned manner, the assigning means 15 performs integral evaluation of each of the cars in a step S104. As the method for the evaluation, for instance, the below-mentioned integral evaluation function "J(i)" is employed.

$$J(i)+w1E1(i)+w2E2(i)+w3E3(i)+w4E4(i) \quad (1)$$

where:

symbols W1, W2, W3, and W4 each denote weight;

symbol E1(*i*) denotes a sum of waiting time evaluation with respect to each of car calls under execution in the case where a car "i" is assigned to a new hall call;

symbol E2(*i*) denotes a sum of mis-forecast probability evaluation with respect to each of car calls under execution in the case where the car "i" is assigned to a new hall call;

symbol E3(*i*) denotes a sum of full-car probability evaluation with respect to each of car calls under execution in the case where the car "i" is assigned to a new hall call; and symbol E4(*i*) denotes a sum of travel distance evaluation with respect to each of car calls in the case where the car "i" is assigned to a new hall call.

Next, in a step S105, the assigning means 15 determines such a car that the value of the integral function "J(i)" calculated in the above-explained step S104 becomes optimal, namely a minimum value as the assigned car.

Then, in a step S106, the operation control means 16 outputs an assignment instruction to the assigned car via the communication means 11 and the each car control apparatuses 20.

As previously explained, in accordance with Embodiment 1 the travel distances of the elevators can be reduced. As a result, it is apparent that the energy saving effect can be achieved. Also, as an indirect effect, useless travels of the respective elevators can be reduced, so the waiting time can be improved.

Embodiment 2

Figure 4:
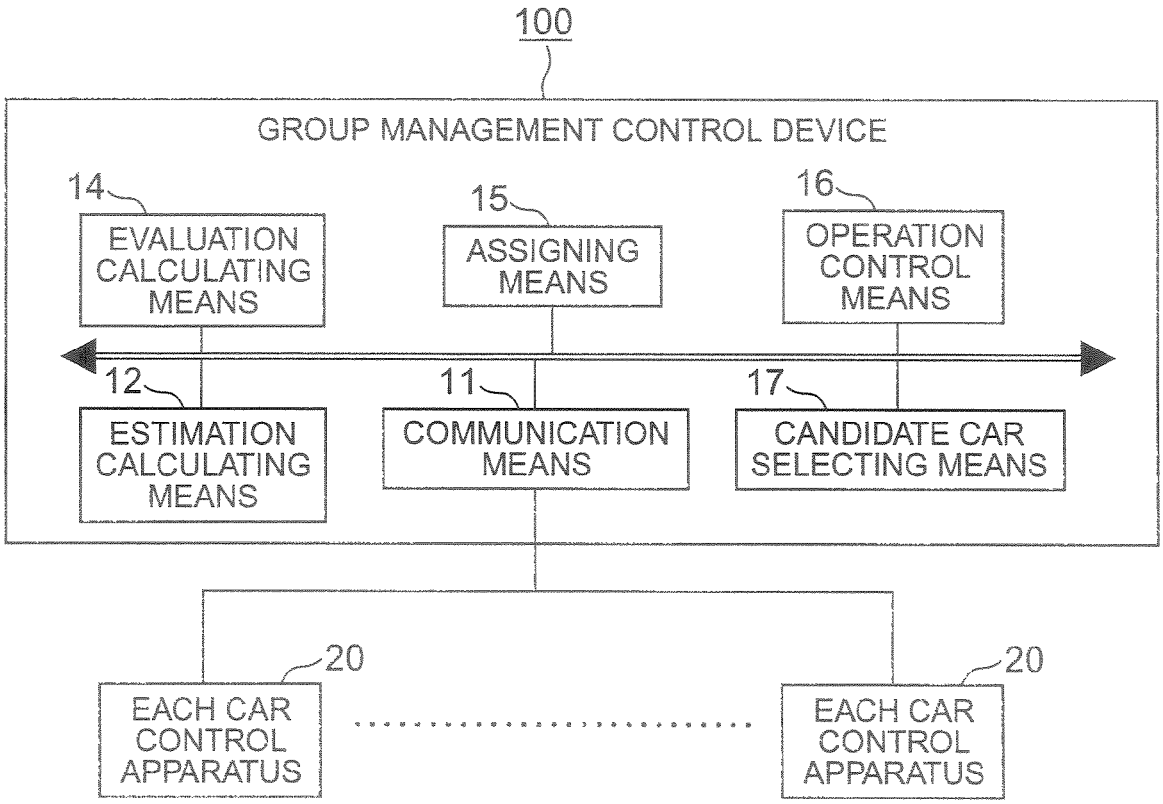
[FIG. 4] A block diagram for showing a functional arrangement of an elevator group management control device according to Embodiment 2 of the present invention.
Figure 5:
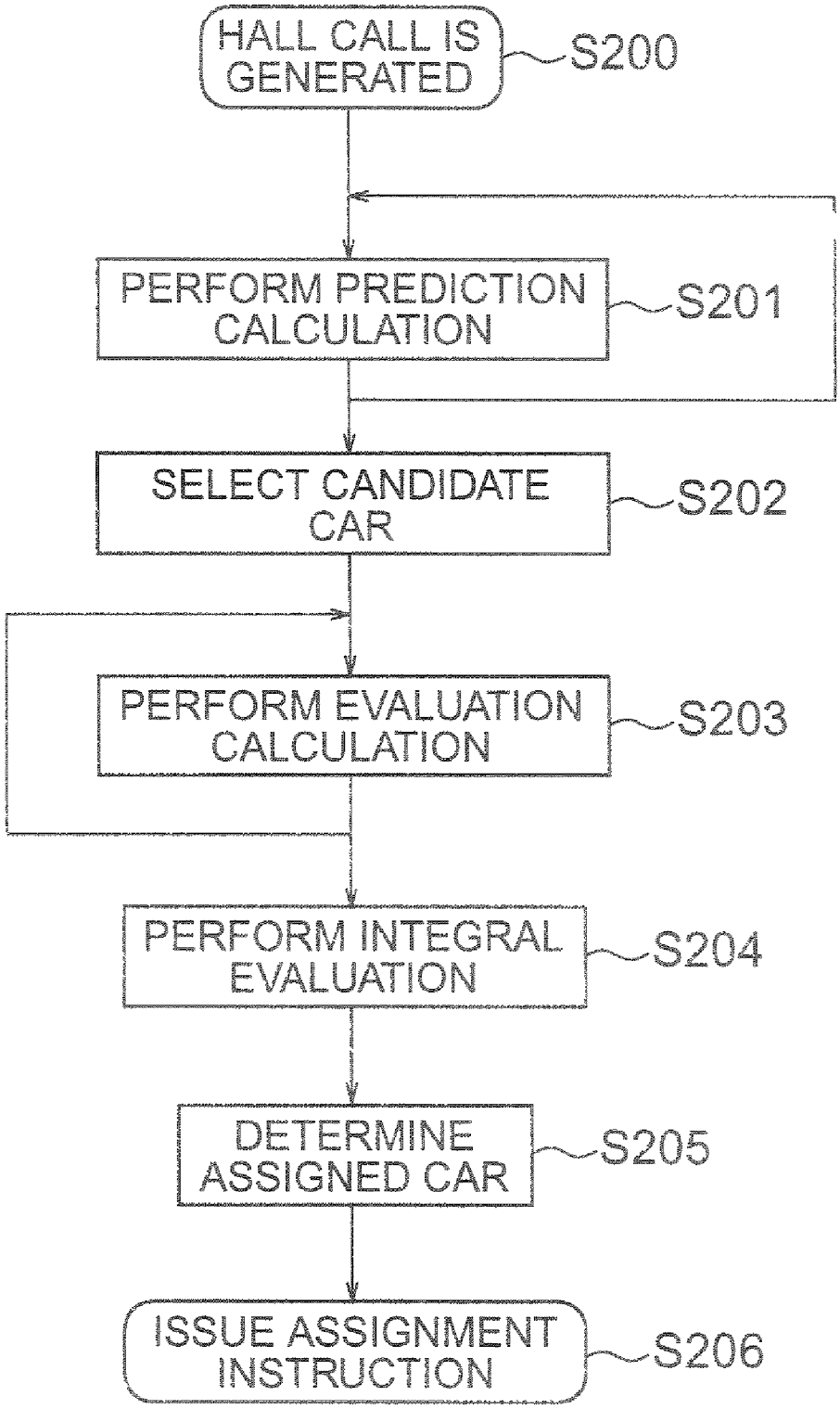
[FIG. 5] A flow chart for describing operations of the elevator group management control device according to Embodiment 2 of the present invention.
Figure 6A:
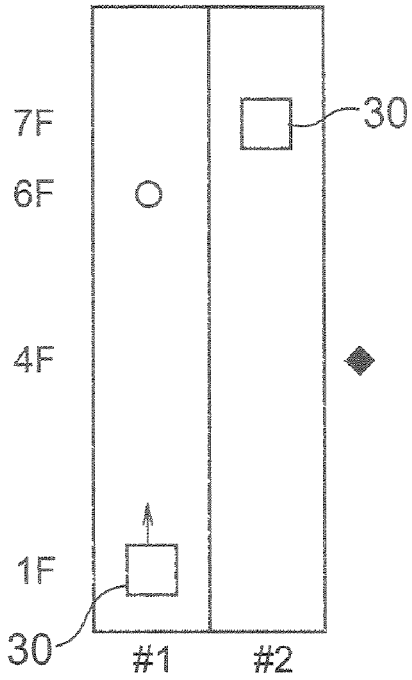
[FIG. 6] A diagram for explaining an operation of candidate car selecting means of the elevator group management control device according to Embodiment 2 of the present invention.
Figure 6B:
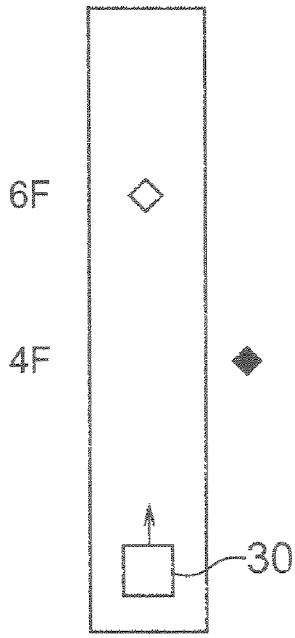
Figure 6C:
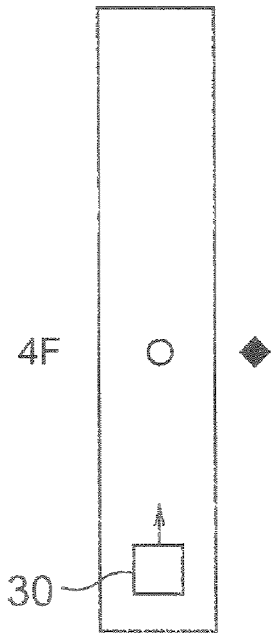
Figure 6D:
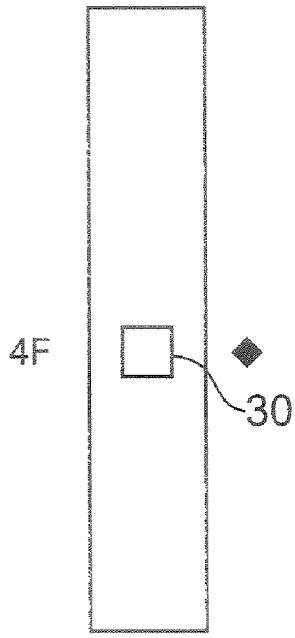

An elevator group management control device according to Embodiment 2 of the present invention will now be explained with reference to FIG. 4 to FIG. 6. FIG. 4 is a block diagram for showing a functional arrangement of the elevator group management control device according to Embodiment 2 of the present invention.

In FIG. 4, a group management control device 100 efficiently supervises (i.e., assigns)/controls a plurality of cars (not shown), and a plurality of each car control apparatuses 20 control each of cars respectively. The plurality of each car control apparatuses 20 are connected to the group management control device 100.

Also the group management control device 100 includes communication means 11, estimation calculating means 12, evaluation calculating means 14, assigning means 15, operation control means 16, and candidate car selecting means 17. The respective means 11, 12 and 14 to 17 are constructed by software on a microcomputer.

The communication means 11 communicates information with respect to the each car control apparatuses 20, and the like. The estimation calculating means 12 performs a prediction calculation as to, for example, how many seconds it takes for each of elevators to reach each of floors. The candidate car selecting means 17 selects an assigned candidate car with respect to a new hall call according to positions and directions of the respective elevators, all of acceptable car calls, and the new hall call. The evaluation calculation means 14 calculates various sorts of evaluation items such as waiting time evaluation based upon calculation results of the estimation calculating means 12 with respect to the candidate car selected by the candidate car selecting means 17. The assigning means 15 performs integral evaluation based upon the evaluation calculation result of the evaluation calculating means 14 to assign a proper elevator (car) with respect to a new hall call. The operation control means 16 controls operations of each of elevators in response to an assigned result.

Next, operations of the elevator group management control device according to Embodiment 2 will now be described with reference to drawings. FIG. 5 is a flow chart for describing operations of the elevator group management control device according to Embodiment 2 of the present invention. FIG. 6 is a diagram for explaining operation of the candidate car selecting means of the elevator group management control device according to Embodiment 2 of the present invention.

First, when a hall call is newly registered in a step S200, the estimation calculating means 12 performs a prediction calculation with respect to each of the cars in a step S201. The prediction calculation is equivalent to the procedure of the step S101 of FIG. 2. The prediction calculation is carried out in both cases that the new hall call is provisionally assigned for each of the cars, and is not provisionally assigned thereto. In order to represent this procedure, a return line is drawn from the exit of the step S201 to the entrance thereof.

Next, in a step S202, the candidate car selecting means 17 selects a candidate car which is assigned with respect to the new hall call. This procedure will now be explained by employing an example of FIG. 6. In the example of FIG. 6, a car 30 of a first elevator (i.e., #1) owns a car call (denoted by symbol "○") at 6F (i.e., sixth floor), and is about to start from 1F (i.e., first floor), whereas a car 30 of a second elevator (i.e., #2) is under waiting status at 7F (i.e., seventh floor). Under such the condition, there is such a case that a new hall call (denoted by symbol "◆") of Up (i.e., ascent) is generated at 4F (i.e., fourth floor). In this case, no matter which one of the cars 30 of the first and second elevators is assigned to the Up hall call of the 4F, the car 30 can arrive at the substantially same time. However, it is obvious that a total travel distance when the car 30 of the first elevator is assigned becomes shorter than a total travel distance when the car 30 of the second elevator is assigned. In other words, when the car 30 of the first elevator is assigned to the Up hall call of 4F, a travel route defined by 1F→4F→6F may be predicted. On the other hand, when the car 30 of the second elevator is assigned to the Up hall call of 4F, a travel route defined by 7F→4F→7F may be predicted, so that the total travel distance of the former case becomes shorter than that of the latter case. The travel route of 7F→4F→7F corresponds to, for example, as explained in Embodiment 1, such a case that the travel distance is estimated by the method for predicting the just center floor from the uppermost floor (i.e., 10F) up to the get-in floor (i.e., 4F) as the destination floor.

In an example of FIG. 6(*b*), the car 30 owns an assigned hall call (denoted by symbol "Δ"), and is about to start from 1F, and also, a new hall call (denoted by symbol "◆") of Up is generated at 4F. As previously explained, as exemplified in the example of the first elevator of FIG. 6(*a*), or in the example of FIG. 6(*b*), if the hall call is assigned to such a car which is traveling in the same direction as the new hall call, or which is scheduled to travel in this direction, a travel distance can also be shortened.

In this example, the car operated under such the status is selected as the assigned candidate in a top priority to reduce the travel distance. As a concrete method for this purpose, for example, the below-mentioned first rule is employed:

IF ((car which owns car call at such a floor that new hall call is generated) or (car to which new hall call is assigned at own floor)), or ((car which is traveling, or is scheduled to travel in the same direction as new hall call) and (car which owns only one car call in the same direction and forward direction as those of new hall call)), THEN (relevant car is defined as assigned candidate car).

A front half portion and a rear half portion of a first "or" condition within the above-explained rule can clarify that a sum of the travel distances as to all of the cars becomes short if the following assigning case is conducted, as apparent from examples shown in FIG. 6(*c*) and FIG. 6(*d*). That is, in the case where a new hall call is generated at such a floor (i.e., 4F) that a car owns a car call and is scheduled to be stopped, and also, in the case of the own floor as assignment (i.e., new hall call is generated at such a floor (i.e., 4F) that car 30 is presently stopped), if a new hall call is assigned to such the car, then the total travel distance as to all of the cars is reduced.

Also, a front half portion of "and" condition indicates such a case which corresponds to FIG. 6(*a*) and FIG. 6(*b*). However, even when such a car which owns a hall call in the same direction and the forward direction as those of the new hall case, if the new hall call is assigned to such a car to which a large number of elevator calls have already been assigned, a long waiting status may occur, and thus, the entire transportation efficiency of the building may be deteriorated. This long waiting status is equal to or longer than, for example, 60 seconds, but is not limited thereto, namely, may become longer than, or equal to 40 seconds, 50 seconds, 70 seconds, or 80 seconds. As a consequence, a rear half portion of the "and" condition is a condition for selecting a car whose number of scheduled stop times is equal to or smaller than a predetermined number in order to avoid a deterioration of the transportation efficiency.

Also, in the same meaning, the below-mentioned second rule may be employed in which the rear half portion of the "and" condition is changed:

IF ((car which owns car call at such a floor that new hall call is generated), or (car to which new hall call is assigned at own floor)), or ((car which is traveling, or is scheduled to travel in same direction as new hall call) and (car which does not generate long wait status even when new hall call is assigned)), THEN (relevant car is defined as assigned candidate car).

In the step S202, a selection is made of an assigned candidate car with respect to the new hall call by employing the above-explained first rule and second rule. It should be understood that there are some possibilities that such a car capable of satisfying the above-mentioned first rule and second rule is not present in a certain case. In this case, all of the cars are newly selected as the candidate cars. Even in such a case, the assigned car may be determined in accordance with at least the same procedure as the conventional determining procedure.

Figure 2:
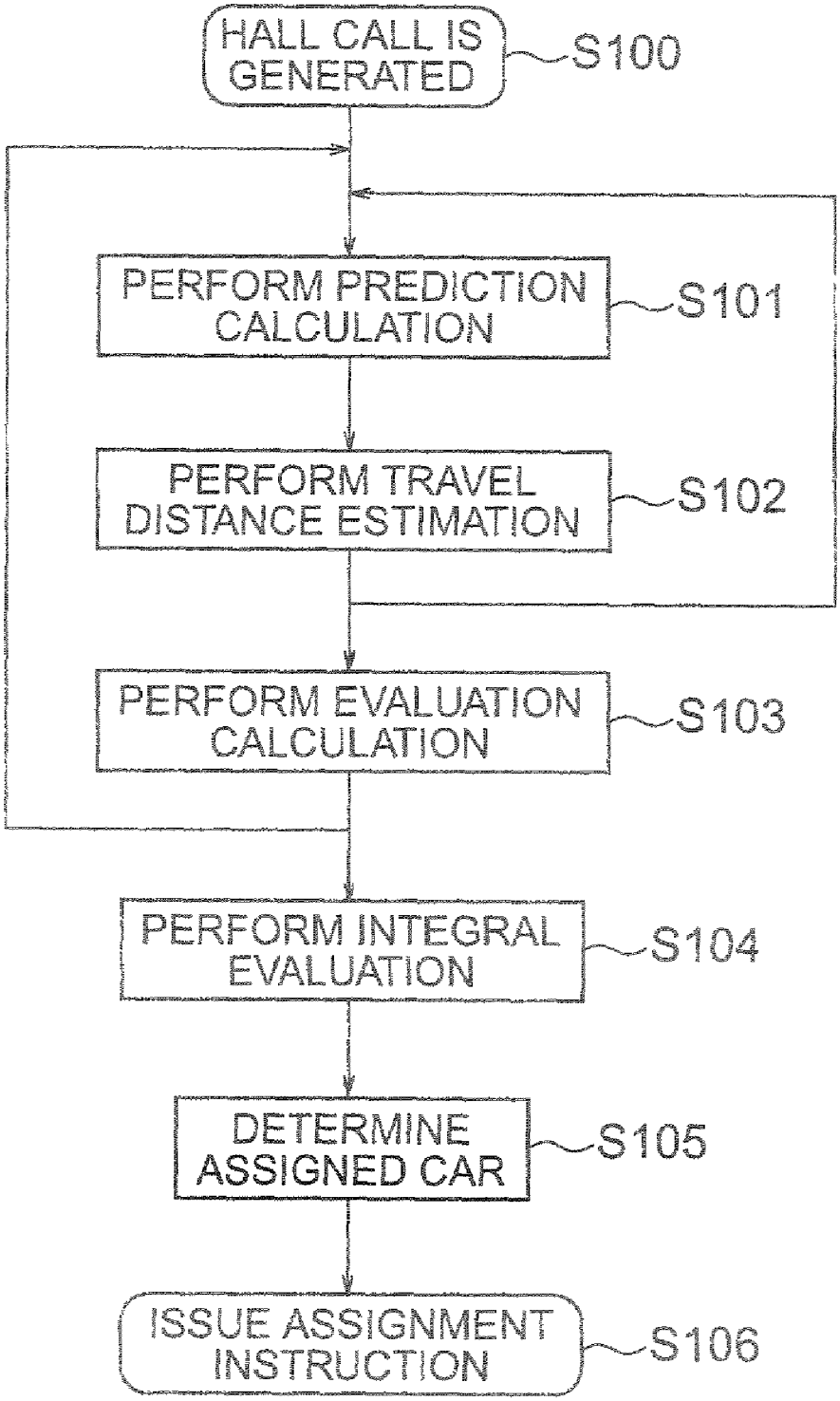
[FIG. 2] A flow chart for describing operations of the elevator group management control device according to Embodiment 1 of the present invention.

Also, in a step S203, various sorts of evaluation values similar to those of the step S103 shown in FIG. 2 are calculated with respect to the candidate car selected in the step S202. It should be understood that the above-explained evaluation value calculation is not carried our as to a travel distance in Embodiment 2. The evaluation calculation is carried out with respect to each of the candidate cars. In order to express the evaluation calculation, a return line is illustrated from the exit of the step 203 to the entrance thereof.

Next, in a step S204, the assigning means 15 performs integral evaluation with respect to each of the cars selected as the candidate car by employing, for example, an integral evaluation function "J(i)" represented in the below-mentioned formula (2):

$$J(i)=w1E1(i)+w2E2(i)+w3E3(i) \quad (2)$$

where:

symbols W1, W2, and W3 each denote weight;

symbol E1(*i*) denotes a sum of waiting time evaluation with respect to each of car calls under execution in the case where a car "i" is assigned to a new hall call;

symbol E2(*i*) denotes a sum of mis-forecast probability evaluation with respect to each of car calls under execution in the case where the car "i" is assigned to a new hall call; and symbol E3(*i*) denotes a sum of full-car probability evaluation with respect to each of car calls under execution in the case where the car "i" is assigned to a new hall call.

The above-mentioned formula (2) is equivalent to the formula (1) except that the evaluation item related to the travel distance is omitted.

Next, in a step S205, such a car is determined that the value of the integral function "J(i)" calculated in the above-explained step S204 becomes optimal, namely a minimum value as the assigned car. In a step 206 an assignment instruction is performed with respect to the assigned car.

In accordance with Embodiment 2, there is provided an assigning means for assigning such an elevator, at a top priority, which is raveling in the same direction as that of a new hall call in the building where a plurality of elevators are operated, in such a case that a hall call is generated. As a result, the travel distances of the respective elevators can be reduced, and the energy saving effect can be achieved without increasing the waiting time. Also, there is provided an assigning means for assigning such an elevator, at a top priority, which is traveling in the same direction as that of a new hall call in such a case that a hall call is issued without generating long waiting status even when a new hall call is assigned to an elevator. As a result, while the transportation efficiency is maintained, the travel distances of the respective elevators can be reduced, and the energy saving effect can be achieved without increasing the waiting time. Further, there is provided an assigning means for assigning such an elevator, at a top priority, which is traveling in the same direction as that of a new hall call, while the scheduled number of stop mimes is smaller than the predetermined number in the case where a hall call is generated. As a consequence, while the transportation efficiency is maintained, the travel distances of the respective elevators can be reduced, and the energy saving effect can be achieved without increasing the waiting time.

The invention claimed is:

1. An elevator group management control device for efficiently operating a plurality of elevators, comprising:

estimation calculating means for predicting an arrival time by which each car of the elevators can arrive from a present position to a floor where a hall call is generated;

travel distance estimating means for estimating a travel distance for each car over which the car travels from the present positions respectively to stop in response to every car call that is to be handled by the car;

evaluation calculating means for calculating a waiting time with respect to the hall call based upon the arrival time predicted by the estimation calculating means, for performing a waiting time evaluating calculation by employing a first evaluation function while the waiting time is employed as an evaluation index, and also for performing a travel distance evaluating calculation by employing a second evaluation function while the travel distance estimated by the travel distance estimating means is employed as an evaluation index; and assigning means for performing a calculation of an integral evaluation function which contains at least the waiting time evaluation and the travel distance evaluation as to each of the cars, and for assigning a car whose integral evaluation function value is minimum with respect to the hall call.

2. An elevator group management control device according to claim 1, wherein, when, while the car is traveling from a first floor in a descent direction, a car call is generated at a second floor and a descent hall call is generated at an intermediate floor between the first floor and the second floor, the travel distance estimating means estimates the travel distance of the car as a distance from the first floor to the second floor.

3. An elevator group management control device according to claim 2, wherein, when, while the car is traveling from an uppermost floor in the descent direction, a car call is generated at a lowermost floor and a descent hall call is generated at an intermediate floor between the uppermost floor and the lowermost floor, the travel distance estimating means estimates the travel distance of the car as a distance from the uppermost floor to the lowermost floor.

4. An elevator group management control device according to claim 1, wherein, when, while the car is traveling from the second floor in an ascent direction, a car call is generated at the first floor and an ascent hall call is generated at an intermediate floor between the second floor and the first floor, the travel distance estimating means estimates the travel distance of the car as a distance from the second floor to the first floor.

5. An elevator group management control device according to claim 4, wherein, when, while the car is traveling from an lowermost floor in an ascent direction, a car call is generated at an uppermost floor and an ascent hall call is generated at an intermediate floor between the lowermost floor and the uppermost floor, the travel distance estimating means estimates the travel distance of the car as a distance from the lowermost floor to the uppermost floor.

6. An elevator group management control device according to claim 1, wherein, when while the car is traveling from a first floor in a descent direction, a car call is generated at a second floor and an ascent hall call is generated at an intermediate floor between the first floor and the second floor, the travel distance estimating means predicts a destination floor as to the ascent hall call, and estimates the travel distance of the car as a distance from the first floor to the destination floor via the second floor.

7. An elevator group management control device according to claim 6, wherein, when, while the car is traveling from an uppermost floor in a descent direction, a car call is generated at a lowermost floor and an ascent hall call is generated at an intermediate floor between the uppermost floor and the lowermost floor, the travel distance estimating means predicts a destination floor as to the ascent hall call, and estimates the travel distance of the car as a distance from the uppermost floor to the destination floor via the lowermost floor.

8. An elevator group management control device according to claim 1, wherein, when, while the car is traveling from a second floor in an ascent direction, a car call is generated at a first floor and a descent hall call is generated at an intermediate floor between the first floor and the second floor, the travel distance estimating means predicts a destination floor as to the descent hall call, and estimates the travel distance of the car as a distance from the second floor to the destination floor via the first floor.

9. An elevator group management control device according to claim 8, wherein, when, while the car is traveling from a lower most floor in an ascent direction, a car call is generated at an uppermost floor and a descent hall call is generated at an intermediate floor between the lowermost floor and the uppermost floor, the travel distance estimating means predicts a destination floor as to the descent hall call, and estimates the travel distance of the car as a distance from the lowermost floor to the destination floor via the uppermost floor.

10. An elevator group management control device according to claim 6, wherein, in predicting the destination floor as to the ascent hall call, the travel distance estimating means adds up get-off probabilities at each floor located between either the first floor or the uppermost floor and the intermediate floor from either the first floor or the uppermost floor, and predicts the destination floor as a floor at which the get-off probabilities add up to 50 percent.

11. An elevator group management control device according to claim 6, wherein, in predicting the destination floor as to the ascent hall call, the travel distance estimating means predicts the destination floor as a floor located midway between either the first floor or the uppermost floor and the intermediate floor.

12. An elevator group management control device according to claim 8, wherein, in predicting the destination floor as to the descent hall call, the travel distance estimating means adds up get-off probabilities at each floor located between either the second floor or the lowermost floor and the intermediate floor from either the second floor or the lowermost floor, and predicts the destination floor as a floor at which the get-off probabilities add up to 50 percent.

13. An elevator group management control device according to claim 8, wherein, in predicting the destination floor as to the descent hall call, the travel distance estimating means predicts the destination floor as a floor located midway between either the second floor or the lowermost floor and the intermediate floor.

14. An elevator group management control device for efficiently operating a plurality of elevators, comprising:

estimation calculating means for predicting an arrival time by which each car of the elevators can arrive from a present position to a floor where a hall call is generated;

candidate car selecting means for estimating a travel distance over which the each car travels from the present position to stop in response to every car call that is to be handled by the car so as to select a car whose estimated travel distance is short as a candidate car to be assigned;

evaluation calculating means for calculating a waiting time with respect to the hall call based upon the arrival time predicted by the estimation calculating means, for performing a waiting time evaluation calculation by employing a predetermined evaluation function while the waiting time is employed as an evaluation index; and assigning means for performing a calculation of an integral evaluation function which contains at least the waiting time evaluation as to the candidate car, and for assigning a car whose integral evaluation function value is minimum with respect to the hall call.

15. An elevator group management control device according to claim 14, wherein, the candidate car selecting means selects the candidate car to be assigned, based upon such a rule: IF ((a car has a car call at such a floor that a new hall call is generated), or (a car to which new hall call is assigned at own floor)), or ((a car is traveling, or is scheduled to travel in same direction as the new hall call) and (a car has only one car call in same direction and also forward direction as those of the new hall call)), THEN (the car is defined as a candidate car to be assigned).

16. An elevator group management control device according to claim 14, wherein, the candidate car selecting means selects the candidate car to be assigned, based upon such a rule: IF ((a car has a car call at such a floor that a new hall call is generated), or (a car to which new hall call is assigned at own floor)) or ((a car is traveling, or is scheduled to travel in same direction as the new hall call) and (a car to which a new hall call can be assigned without a fear of increasing waiting time)), THEN (the car is defined as a candidate car to be assigned).

17. An elevator group management control device according to claim 7, wherein, in predicting the destination floor as to the ascent hall call, the travel distance estimating, means adds up get-off probabilities at each floor located between either the first floor or the uppermost floor and the intermediate floor from either the first floor or the uppermost floor, and predicts the destination floor as a floor at which the get-off probabilities add up to 50 percent.

18. An elevator group management control device according to claim 7, wherein, in predicting the destination floor as to the ascent hall call, the travel distance estimating means predicts the destination floor as a floor located midway between either the first floor or the uppermost floor and the intermediate floor.

19. An elevator group management control device according to claim 9, wherein, in predicting the destination floor as to the descent hall call, the travel distance estimating means adds up get-off probabilities at each floor located between either the second floor or the lowermost floor and the intermediate floor from either the second floor or the lowermost floor, and predicts the destination floor as a floor at which the get-off probabilities add up to 50 percent.

20. An elevator group management control device according to claim 9, wherein, in predicting the destination floor as to the descent hall call, the travel distance estimating means predicts the destination floor as a floor located midway between either the second floor or the lowermost floor and the intermediate floor.

* * * * *